US006505619B2

(12) United States Patent
Hulm

(10) Patent No.: US 6,505,619 B2
(45) Date of Patent: Jan. 14, 2003

(54) ARROW FALL-OFF BUMPER SYSTEM

(76) Inventor: Donald E. Hulm, 916 NE. Sixth St., Madison, SD (US) 57042

( * ) Notice: Subject to any disclaimer, the term of this patent is extended or adjusted under 35 U.S.C. 154(b) by 0 days.

(21) Appl. No.: 09/769,213

(22) Filed: Jan. 24, 2001

(65) Prior Publication Data

US 2002/0096161 A1 Jul. 25, 2002

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,715,355 A * 12/1987 Lattig
4,748,964 A * 6/1988 Troncoso
5,144,937 A * 9/1992 Colvin ..... 124/44.5
5,251,606 A * 10/1993 Colvin ..... 124/44.5
5,375,584 A * 12/1994 Hsu ..... 124/44.5
5,385,135 A * 1/1995 Saunders ..... 124/44.5
6,021,769 A * 2/2000 Troncoso ..... 124/44.5

* cited by examiner

*Primary Examiner*—John A. Ricci
(74) *Attorney, Agent, or Firm*—Michael S. Neustel

(57) ABSTRACT

An arrow fall-off bumper system for maintaining an arrow in the desired position upon an arrow support rest. The arrow fall-off bumper system includes a side support member that is threadably attached within a threaded aperture of a bow adjacent a support rest. The side support member is generally comprised of a threaded shaft and a head wherein the head engages the shaft of the arrow when accidentally removed from the support rest. The head is preferably rounded and comprised of a molded rubber cap to reduce damage to the arrow. At least one spacer washer may be utilized to adjust the position of the head with respect to the support rest.

11 Claims, 5 Drawing Sheets

ARROW FALL-OFF BUMPER SYSTEM

BACKGROUND OF THE INVENTION

1. Field of the Invention

The present invention relates generally to arrow rest devices and more specifically it relates to an arrow fall-off bumper system for maintaining an arrow in the desired position upon an arrow support rest.

2. Description of the Prior Art

Arrow support rests have been in use for years. Typically, an arrow support rest is comprised of a structure that is attached to the side member of a bow extending below the normal position of the arrow so as to support the arrow in a desired position. Most arrow support rests include a pair of extended prongs that are positioned on opposing sides of the arrow shaft. The user is able to retain the arrow upon the bow without having to physically grasp the arrow during non-usage.

However, a problem occurs when the user moves the bow around which causes the arrow to fall from the support rest. The arrow often times becomes "jammed" between the arrow support rest and the side member of the bow. Other times the arrow simply falls completely from the support rest and bow.

While these devices may be suitable for the particular purpose to which they address, they are not as suitable for maintaining an arrow in the desired position upon an arrow support rest. Conventional arrow support rests are not capable of effectively supporting an arrow for extended periods of time.

In these respects, the arrow fall-off bumper system according to the present invention substantially departs from the conventional concepts and designs of the prior art, and in so doing provides an apparatus primarily developed for the purpose of maintaining an arrow in the desired position upon an arrow support rest.

SUMMARY OF THE INVENTION

In view of the foregoing disadvantages inherent in the known types of support rests now present in the prior art, the present invention provides a new arrow fall-off bumper system construction wherein the same can be utilized for maintaining an arrow in the desired position upon an arrow support rest.

The general purpose of the present invention, which will be described subsequently in greater detail, is to provide a new arrow fall-off bumper system that has many of the advantages of the arrow support rests mentioned heretofore and many novel features that result in a new arrow fall-off bumper system which is not anticipated, rendered obvious, suggested, or even implied by any of the prior art arrow support rests, either alone or in any combination thereof.

To attain this, the present invention generally comprises a side support member that is threadably attached within a threaded aperture of a bow adjacent a support rest. The side support member is generally comprised of a threaded shaft and a head wherein the head engages the shaft of the arrow when accidentally removed from the support rest. The head is preferably rounded and comprised of a molded rubber cap to reduce damage to the arrow. At least one spacer washer may be utilized to adjust the position of the head with respect to the support rest.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an arrow fall-off bumper system that will overcome the shortcomings of the prior art devices.

A second object is to provide an arrow fall-off bumper system for maintaining an arrow in the desired position upon an arrow support rest.

Another object is to provide an arrow fall-off bumper system that is simple in structure.

An additional object is to provide an arrow fall-off bumper system that can be attached to most bows without modification.

A further object is to provide an arrow fall-off bumper system that is lightweight.

Another object is to provide an arrow fall-off bumper system that does not interfere with the normal operation of the bow nor the flight of the arrow.

A further object is to provide an arrow fall-off bumper system that automatically manipulates an accidentally removed arrow back upon the arrow support rest before the arrow is completely off the support rest.

Another object is to provide an arrow fall-off bumper system that is adjustable to fit within various structures of bows and support rests.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
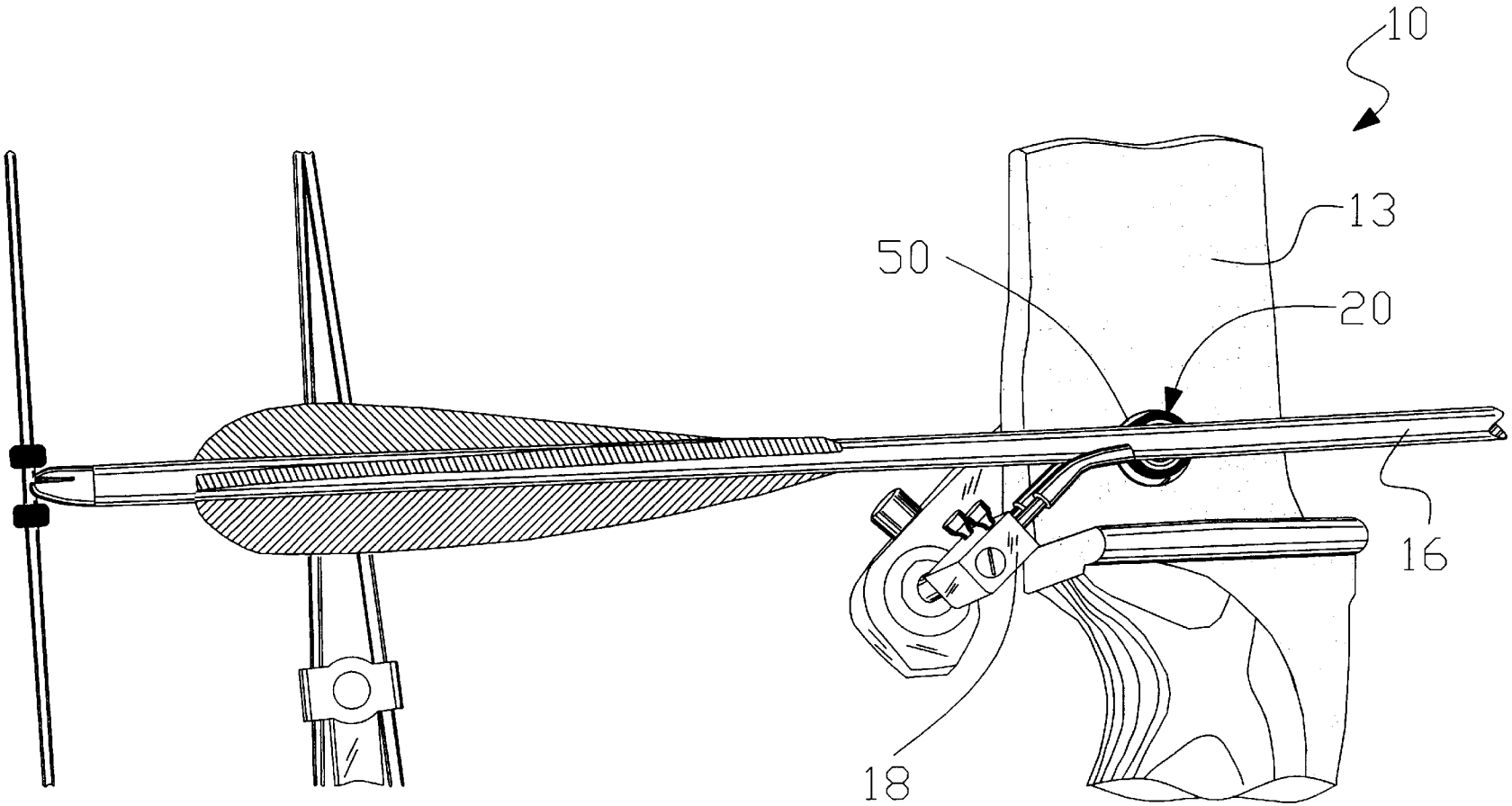
FIG. 1 is a side upper perspective view of the present invention attached to a bow.

Turning now descriptively to the drawings, in which similar reference characters denote similar elements throughout the several views, FIGS. 1 through 8 illustrate an arrow fall-off bumper system 10, which comprises a side support member 20 that is threadably attached within a threaded aperture of a bow 12 adjacent a support rest 18. The side support member 20 is generally comprised of a threaded shaft 30 and a head 40 wherein the head 40 engages the shaft of the arrow 16 when accidentally removed from the support rest 18. The head 40 is preferably rounded and comprised of a molded rubber cap to reduce damage to the arrow 16. At least one spacer washer 50 may be utilized to adjust the position of the head 40 with respect to the support rest 18.

Figure 2:
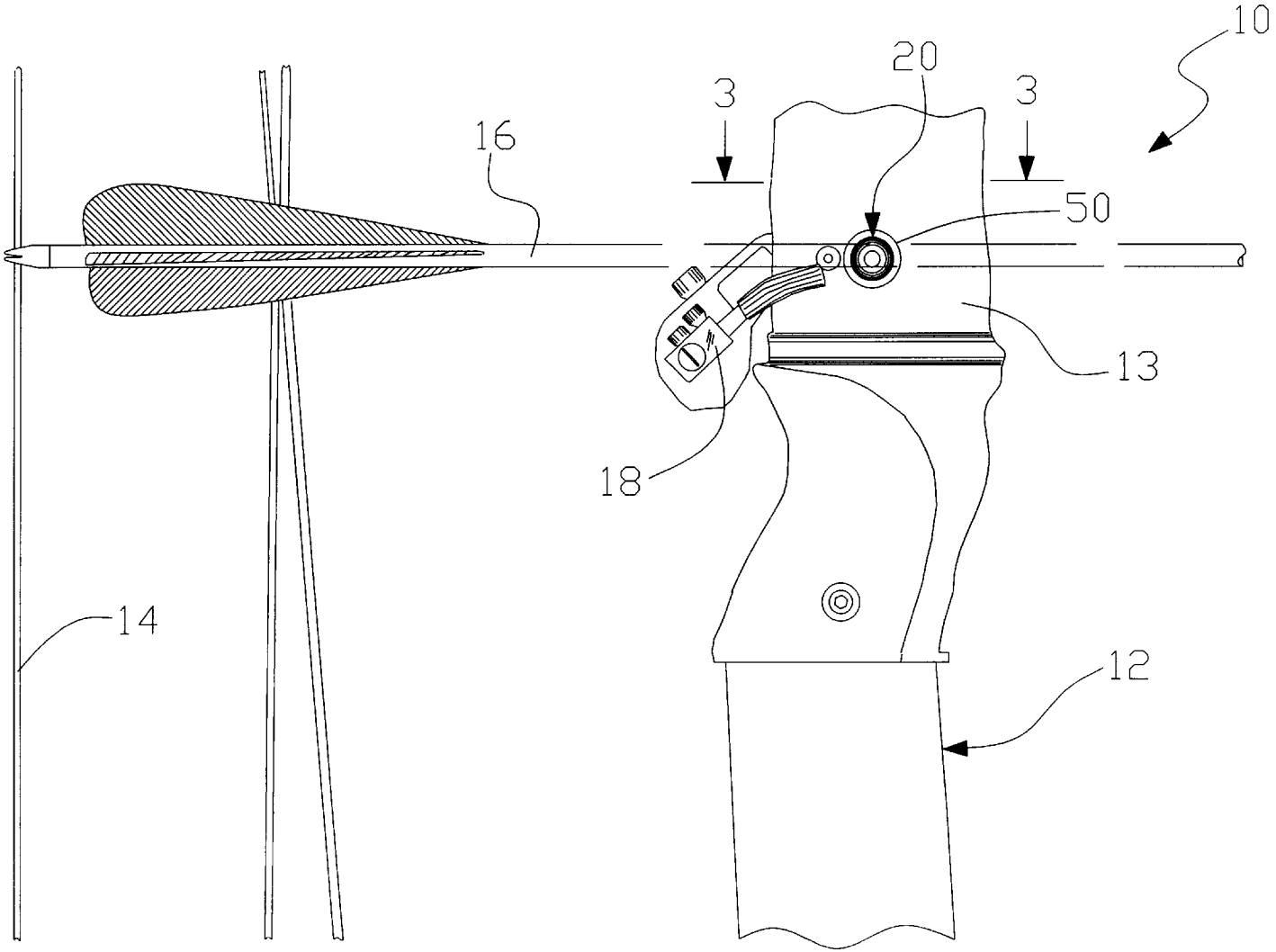
FIG. 2 is a side view of the present invention attached to a bow.
Figure 3:
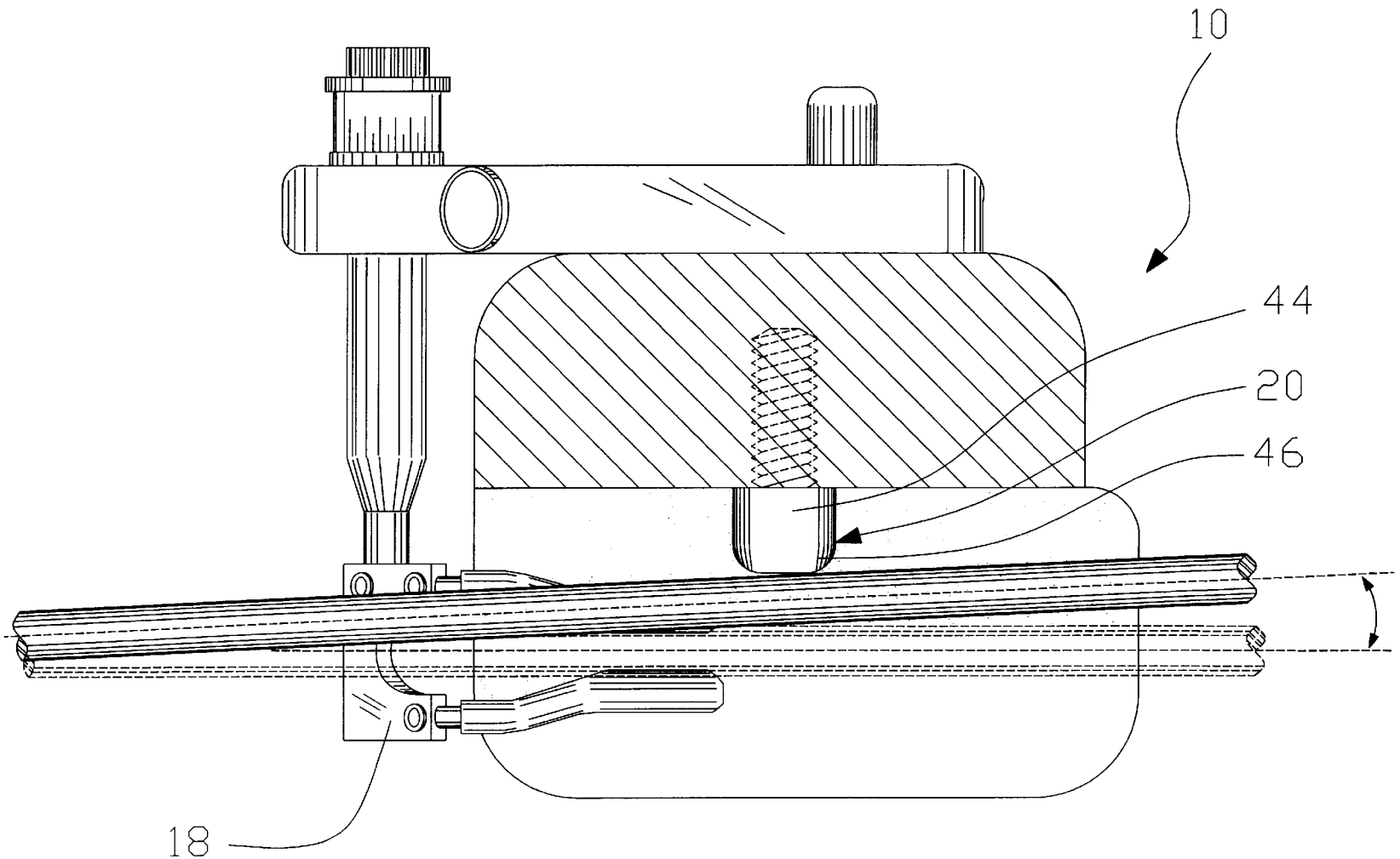
FIG. 3 is a cross sectional view taken along line 3—3 of FIG. 2 illustrating the invention maintaining an arrow within the support rest.

As shown in FIGS. 1 through 3 of the drawings, a conventional bow 12 has a central side member 13 that the user grasps while holding the bow 12 and wherein the arrow 16 passes by during flight. The bow 12 further includes one or more cables 14 that the arrow 16 is engaged with as is commonly found in straight and compound bows 12. A conventional bow 12 typically includes at least one threaded aperture extending into the side member 13 that may be utilized to attach various accessories.

In addition, many users of a conventional bow 12 utilize a support rest 18 that is attached to the side member 13 and extends about the bow 12 to support the arrow 16 before and during initial flight as shown in FIGS. 1 through 3 of the drawings. A conventional support rest 18 typically includes a pair of extended prongs that are slightly curved as best illustrated in FIGS. 1 and 3 of the drawings. As illustrated in FIG. 3 of the drawings, sometimes the arrow 16 falls inwardly toward the side member 13 from the support rest 18 when the bow 12 is either bumped or positioned in an inclined position.

Figure 4:
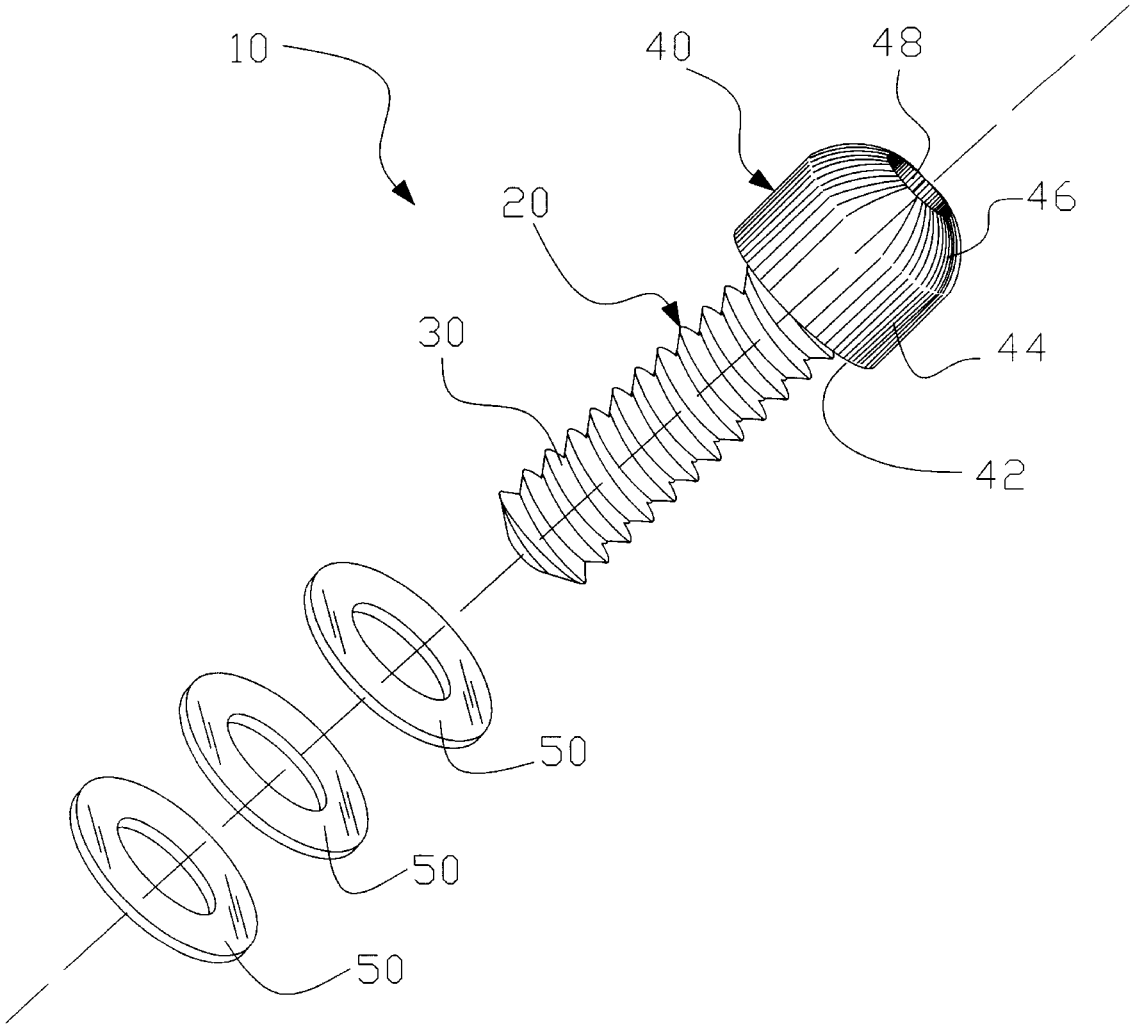
FIG. 4 is an exploded upper perspective view of the present invention illustrating a plurality of spacer washers.
Figure 5:
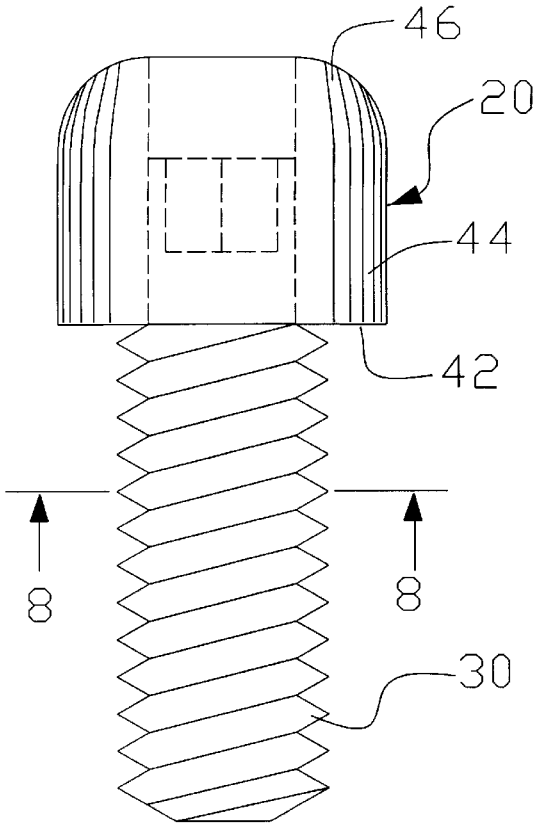
FIG. 5 is a side view of the side support member.

The present invention is comprised of a side support member 20 that is threadably attached within the threaded aperture within the side member 13 as illustrated in FIGS. 1 through 8 of the drawings. The side support member 20 includes a head 40 and a threaded shaft 30 extending from the head 40 as best illustrated in FIGS. 4 and 5 of the drawings. The threaded shaft 30 is formed to threadably engage the threaded aperture within the side member 13 of a conventional bow 12 as illustrated in FIGS. 1 through 3 of the drawings.

Figure 6:
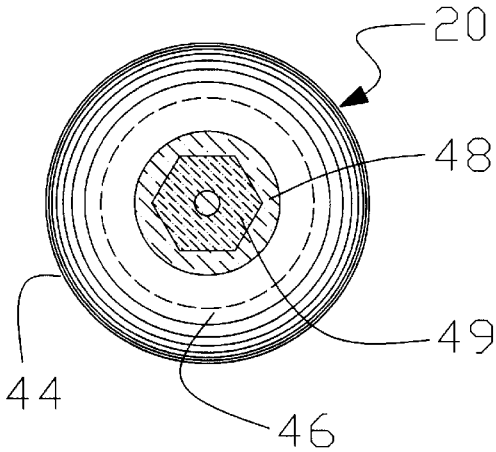
FIG. 6 is an end view of the side support member illustrating the head.
Figure 7:
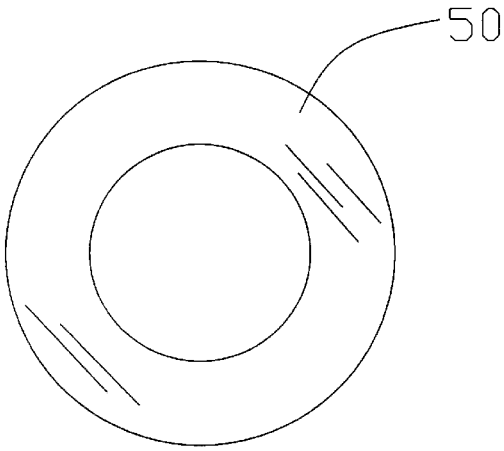
FIG. 7 is an end view of the side support member illustrating the threaded shaft.
Figure 8:
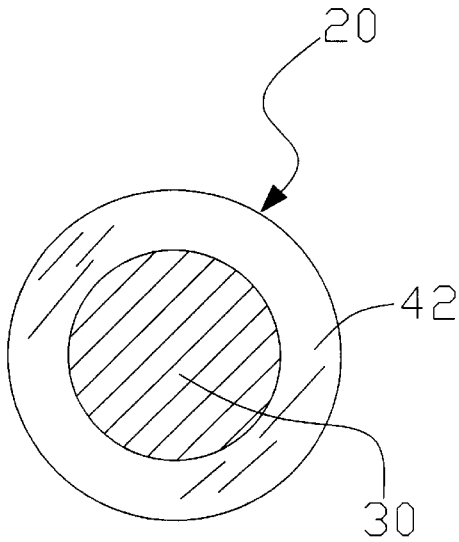
FIG. 8 is a cross sectional view taken along line 8—8 of FIG. 5.

As best illustrated in FIGS. 4 through 6 of the drawings, the head 40 includes a front edge 42, an outer portion 44, an outer curved edge 46, a center cavity 48 and a hexagonal cavity 49. The front edge 42 of the head 40 engages the side member 13 when the side support member 20 is fully tightened within the threaded aperture. The outer curved edge 46 is positionable adjacent the shaft of the arrow 16 to reduce damage to the arrow 16 during flight as illustrated in FIG. 3 of the drawings.

As shown in FIG. 6 of the drawings, the hexagonal cavity 49 is recessed within the head 40 within the center cavity 48 that is capable of receiving a corresponding tool to tighten the side support member 20 into the threaded aperture of the side member 13. It can be appreciated that various other designs commonly utilized for fasteners may be utilized in place of the hexagonal cavity 49 such as but not limited to square, star, groove and cross shaped structures.

The head 40 of the side support member 20 preferably includes a cap member that is constructed of a relatively soft material such as rubber or plastic. The cap member is preferably molded about the head 40 having the corresponding outer portion 44, curved edge 46 and center cavity 48. The cap member is designed to both prevent damage to the arrow 16 during usage and for reducing resistance upon the arrow 16 during flight.

As illustrated in FIGS. 1, 2, 4 and 7 of the drawings, at least one spacer washer 50 is utilized to adjust the relative horizontal position of the head-40 with respect to the shaft of the arrow 16 depending upon the position the support rest 18 places the arrow 16 during usage. If the support rest 18 positions the arrow 16 away from the side member 13 then an increased number of the spacer washers 50 are required. If the support rest 18 positions the arrow 16 near the side member 13 then possibly no spacer washer 50 is required to properly position the side support member 20.

In use, the user threadably inserts the threaded shaft 30 of the side support member 20 into the threaded aperture of the bow 12 side member 13. The user then positions an arrow 16 upon the support rest 18 along with engaging the cables 14 as shown in FIGS. 1 and 2 of the drawings. The user then moves the distal end of the arrow 16 inwardly toward the bow 12 to determine whether the head 40 of the side support member 20 prevents the arrow 16 from falling off the support rest 18. If the arrow 16 is significantly retained within the support rest 18 then there will be no adjustment required as shown in FIG. 3 of the drawings. However, if the arrow 16 is able to fall off the support rest 18 then the user must remove the side support member 20 and position at least one spacer washer 50 about the threaded shaft 30. After the spacer washer 50 is positioned about the threaded shaft 30 of the side support member 20, the user then repositions the side support member 20 within the threaded aperture of the side member 13. The user then repositions the arrow 16 upon the support rest 18 along with engaging the cables 14 as shown in FIGS. 1 and 2 of the drawings. The user then moves the distal end of the arrow 16 inwardly toward the bow 12 to determine whether the head 40 of the side support member 20 prevents the arrow 16 from falling off the support rest 18. If the arrow 16 is significantly retained within the support rest 18 then there will be no further adjustment required. However, if the arrow 16 is still able to fall off the support rest 18 then the user must repeat the above process for adding at least one more spacer washer 50 about the threaded shaft 30. After properly installed upon the bow 12, the side support member 20 prevents the arrow 16 from falling off the support rest 18 inwardly toward the side member 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An arrow fall-off bumper system positionable within a threaded aperture within a side member of a bow for preventing an arrow upon a support rest from falling off the support rest inwardly toward the side member, comprising:

a threaded shaft threadably positionable within the threaded aperture of the bow; and a head having a circular shape attached to the threaded shaft for engaging a shaft of the arrow, wherein said head includes a front edge, an outer portion and an outer curved edge;

wherein said outer curved edge is formed for reducing damage to the shaft of the arrow; and wherein said head includes a center cavity and an engaging cavity within said center cavity, wherein said engaging cavity is for receiving a tool.

2. The arrow fall-of bumper system of claim 1, including at least one spacer washer positionable about said threaded shaft for extending said head outwardly from the side member.

3. The arrow fall-off bumper system of claim 1, including a cap member surrounding said head.

4. The arrow fall-off bumper system of claim 3, wherein said cap member is comprised of a plastic material.

5. The arrow fall-off bumper system of claim 3, wherein said cap member is comprised of a rubber material.

6. An arrow fall-off bumper system positionable within a threaded aperture within a side member of a bow for preventing an arrow upon a support rest from falling off the support rest inwardly toward the side member, comprising:

a threaded shaft threadably positionable within the threaded aperture of the bow;

a head having a circular shape attached to the threaded shaft for engaging a shaft of the arrow, wherein said head includes a front edge, an outer portion and an outer curved edge;

a plurality of spacer washers positioned upon said threaded shaft for providing a desired distance from said side member of said bow for said head;

wherein said outer curved edge is formed for reducing damage to the shaft of the arrow;

wherein said head has a diameter greater than said threaded shaft; and wherein said head includes an engaging cavity within said center cavity, wherein said engaging cavity is for receiving a tool.

7. The arrow fall-off bumper system of claim 6, including at least one spacer washer positionable about said threaded shaft for extending said head outwardly from the side member.

8. The arrow fall-off bumper system of claim 6, including a cap member surrounding said head.

9. The arrow fall-off bumper system of claim 8, wherein said cap member is comprised of a plastic material.

10. The arrow fall-off bumper system of claim 8, wherein said cap member is comprised of a rubber material.

11. A method of installing an arrow fall-off bumper system having a threaded shaft and a head, wherein said threaded shaft is threadably positionable within a threaded aperture within a side member of a bow and wherein said head is for preventing an arrow upon a support rest from falling off the support rest inwardly toward the side member, comprising the steps of:

(a) inserting said threaded shaft into the threaded aperture of the side member;

(b) positioning the arrow upon the support rest;

(c) manipulating the arrow to fall inwardly toward the side member of the bow from the support rest;

(d) determining whether the arrow falls completely from the support rest or whether the arrow remains at least partially upon the support rest;

(e) removing said threaded shaft from the threaded aperture if the arrow falls completely from the support rest as determined in step (d);

(f) positioning at least one spacer washer upon said threaded shaft;

(g) inserting said threaded shaft into the threaded aperture of the side member;

(h) positioning the arrow upon the support rest;

(i) manipulating the arrow to fall inwardly toward the side member of the bow from the support rest;

(j) determining whether the arrow falls completely from the support rest or whether the arrow remains at least partially upon the support rest; and (k) repeating steps (e) through (j) if the arrow falls completely from the support rest as determined in step (j).

* * * * *